United States Patent [19]

Mörz et al.

[11] Patent Number: 4,837,528

[45] Date of Patent: Jun. 6, 1989

[54] MICROWAVE PHASE SHIFTER

[75] Inventors: Günter Mörz, Ludwigsburg; Erich Pivit, Allmersbach; Sigmund Lenz, Aspach, all of Fed. Rep. of Germany

[73] Assignee: ANT Nachrichtentechnik GmbH, Backnang, Fed. Rep. of Germany

[21] Appl. No.: 156,798

[22] Filed: Feb. 17, 1988

[30] Foreign Application Priority Data

Feb. 21, 1987 [EP] European Pat. Off. ..... 87102471.7

[51] Int. Cl.[4] ..... H01P 1/19

[52] U.S. Cl. ..... 333/24.1; 333/1.1; 333/158

[58] Field of Search ..... 333/1.1, 17 L, 24.1, 333/24.2, 158

[56] References Cited

U.S. PATENT DOCUMENTS

| | | | |
|---|---|---|---|
| 2,956,245 | 10/1960 | Duncan . | |
| 3,036,278 | 5/1962 | Chait et al. | 333/1.1 |
| 3,408,597 | 10/1968 | Heiter | 333/24.1 |
| 3,434,076 | 3/1969 | Johnson . | |
| 3,629,735 | 12/1971 | Carter et al. | 333/24.2 X |
| 4,122,418 | 10/1978 | Nagao | 333/219.1 |

FOREIGN PATENT DOCUMENTS

| | | |
|---|---|---|
| 1117183 | 11/1961 | Fed. Rep. of Germany . |
| 2414939 | 11/1985 | Fed. Rep. of Germany . |
| 1548492 | 10/1967 | France . |
| 781024 | 6/1955 | United Kingdom . |
| 836440 | 11/1956 | United Kingdom . |

OTHER PUBLICATIONS

Von Aulock, "Selection of Ferrite Materials for Microwave Device Applications", IEEE Transactions on Magnetics, vol. Mag—2, No. 3, (Sep. 1966), pp. 251-255.

*Primary Examiner*—Paul Gensler

*Attorney, Agent, or Firm*—Spencer & Frank

[57] ABSTRACT

A phase shifter suitable for operation at very high high-frequency power is composed of a waveguide in which ferromagnetic material is distributed along at least one plane extending in the direction of wave propagation. The ferromagnetic material is exposed to a static magnetic field oriented parallel to the plane. The ferromagnetic material is shaped so that it forms a plurality of three-dimensional regions which extend in the direction of the applied static magnetic field from one waveguide wall to the opposite waveguide wall. These regions may be provided by a plurality of ferromagnetic rods, preferably housed in one or more dielectric containers to direct a flow of coolant fluid, or by a ferromagnetic body having a plurality of bores. Such bores also preferably direct a flow of coolant fluid.

12 Claims, 2 Drawing Sheets

MICROWAVE PHASE SHIFTER

BACKGROUND OF THE INVENTION

The present invention relates to a phase shifter composed of a waveguide in which ferromagnetic material is disposed along at least one plane extending in the direction of wave propagation and parallel to the electrical high frequency field, with this ferromagnetic material being exposed to a static magnetic field oriented parallel to the electrical field.

Such a ferrite phase shifter employed in a phase shift circulator is disclosed in German Patent No. 2,414,939.C2. In this prior art phase shifter, the ferromagnetic material is disposed, in the form of strips extending parallel to the longitudinal axis of the waveguide, along the interior sides of two opposing waveguide walls. Although the ferrite strips of this ferrite phase shifter, on which German Patent No. 2,414,939.C2 is based, are designed to have a certain composition of materials suitable for the transmission of high frequency signals in high power pulses, the phase shifter is not suitable for the transmission of high frequency fields at very high constant power since the heat generated in view of the relatively high forward attenuation (about 0.3 dB) can no longer be dissipated.

SUMMARY OF THE INVENTION

It is an object of the present invention to provide a phase shifter of the above-mentioned type which is suitable for operation at very high high-frequency power.

This object can be attained, in accordance with the present invention, by providing a phase shifter having ferromagnetic material with such a shape that it forms a plurality of regions in space which extend in the direction of the applied static magnetic field from one waveguide wall to the opposite waveguide wall.

Due to the configuration of the ferromagnetic material in the phase shifter according to the invention, the phase shifter has a very high breakthrough resistance, thus enabling it to be operated at extremely high power. The configuration of the ferromagnetic material according to the invention additionally permits the dissipation of large amounts of heat, which protects the ferromagnetic material against thermal destruction. This applies primarily for the finely structured configuration of the ferromagnetic material because it ensures a particularly good heat transfer to the heat dissipating dielectric material.

DESCRIPTION OF THE PREFERRED EMBODIMENTS

Figure 1:
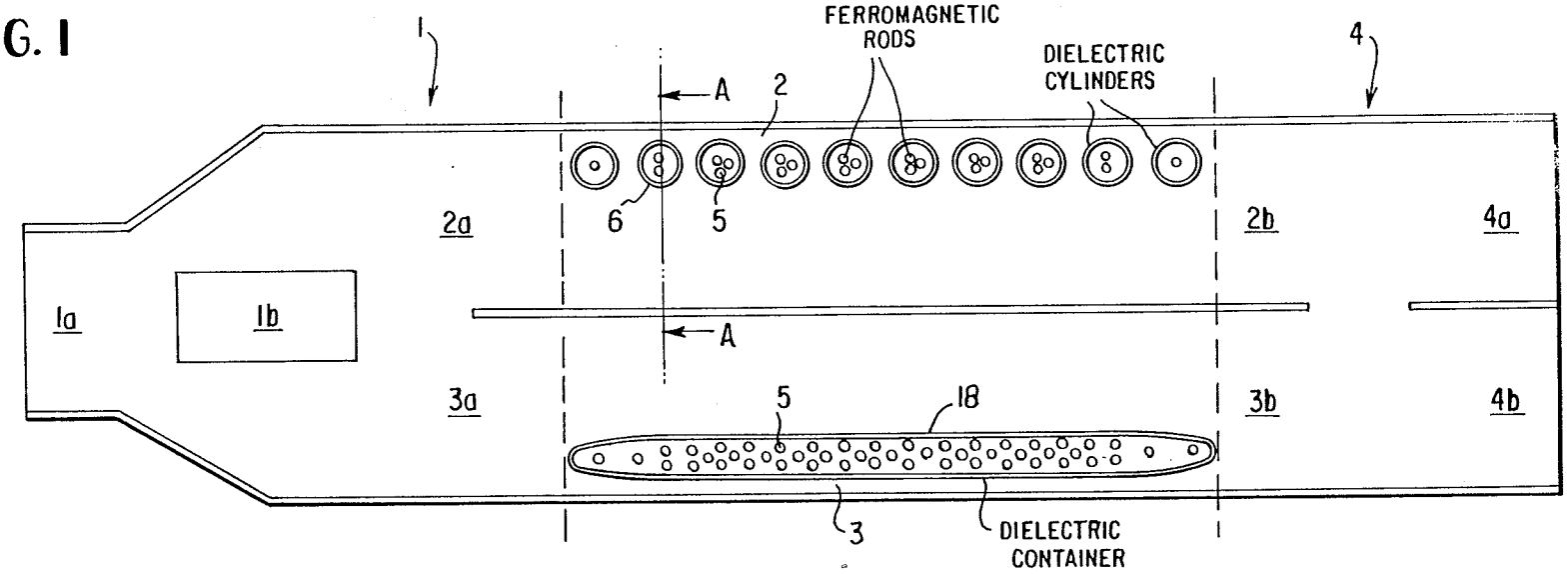
FIG. 1 is a plan view of a phase shifter circulator.

The phase shifter circulator shown in FIG. 1 is composed in a known manner of a magic T waveguide junction 1 having two waveguide arms 2 and 3 configured as ferrite phase shifters and having a 3 dB coupler 4 connected to both waveguide arms 2 and 4. The operation is as follows.

The energy of a high frequency field fed in at port 1a of magic T 1 is divided in equal parts to both ports 2a and 3*a* to which phase shifting waveguide arms 2 and 3 are connected. Phase shifting waveguide arms 2 and 3 are premagnetized in such a way that the high frequency fields passing through them exhibit a mutual phase shift of 90° at phase shifter output ports 2*b* and 3*b*. At its output port 4*a*, the connected 3 dB coupler 4 combines the two high frequency fields present at phase shifter output ports 2*b* and 3*b* so that the high frequency energy fed in at port 1*a* is available in its entirety at port 4*a*, aside from losses occurring within the arrangement.

If, on the other hand, a high frequency energy is applied to port 4*a* of 3 dB coupler 4, its field appears in equal parts at both ports 2*b* and 3*b*, but with a mutual phase shift of 90°. Due to the phase shifting effect of the two arms 2 and 3, the two high frequency fields reach ports 2*a* and 3*a* of magic T 1 in phase opposition. Both high-frequency fields are superposed within magic T 1 and the high frequency energy originally fed into 3 db coupler 4 is finally available at port 1b of magic T 1. In a similar manner, high frequency energy fed into port 1b of the magic T 1 will be finally recombined at port 4*b* of 3 dB coupler 4. And high frequency energy fed into port 4*b* of the 3 dB coupler will be finally recombined at port 1*a* of magic T 1.

In order to operate the phase shifter circulator shown in FIG. 1 at very high power (approximately 100 kW to 2000 kW), the nature of the phase shifters is quite important and here particularly the configuration of the ferromagnetic material disposed in the waveguides.

The ferromagnetic material in phase shifting waveguide arms 2 and 3, respectively, is shaped into a plurality of rods 5 which extend parallel to the narrow sides of the waveguide from one waveguide wall to the opposite one. All ferromagnetic rods 5 are oriented parallel to the electric high frequency field propagating in the waveguide and to an externally applied static magnetic field. Ferrite rods 5 are spaced from one narrow side of the waveguide at a distance which corresponds to approximately 0.2 times the width of the waveguide. In deviation from the embodiment shown in FIG. 1, such ferromagnetic rods may be disposed at equal distances from each of the two narrow waveguide sides.

In order to keep the forward attenuation as a result of spin wave losses as low as possible in a phase shifter subjected to very high high-frequency power, a correspondingly high static magnetic field is applied so that the ferromagnetic rods 5 are operated in a range above gyromagnetic resonance.

Since the ferromagnetic rods 5 extend, without interruption by some other type of dielectric material, over the entire height of the waveguide, undesirable excess field intensities are precluded. This results in high breakthrough resistance of the phase shifter so that it is suitable for the transmission of very high power.

By dividing the ferromagnetic material into a plurality of individual, spaced rods 5, a large cooling area is created, producing extremely favorable conditions for the dissipation of the heat generated in ferromagnetic rods 5. With the aid of a very low loss coolant, e.g. a fluid such as air or some other suitable gas or a dielectric liquid, flowing around ferromagnetic rods 5, very large quantities of heat can be dissipated in a simple matter.

Figure 2:
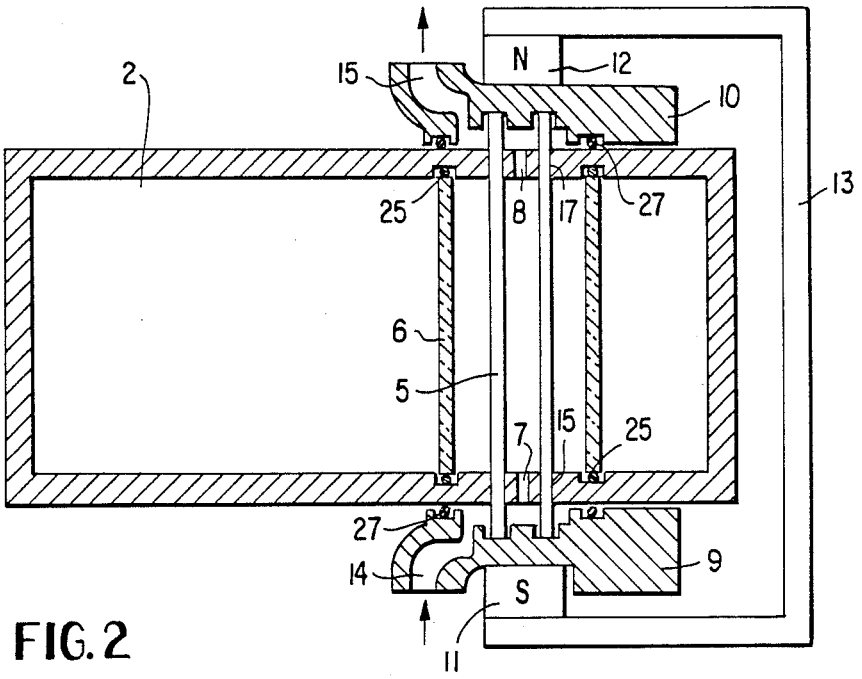
FIG. 2 is a cross-sectional view, taken along line A-A of FIG. 1, through a waveguide arm acting as a phase shifter in the phase shifter circulator.

FIG. 1 shows two embodiments for ways in which ferromagnetic rods 5 can be subjected to a cooling gas or cooling liquid. In waveguide arm 2, a cross-sectional view A-A of which is shown in FIG. 2, the ferromagnetic rods 5 are surrounded individually or in groups by dielectric hollow cylinders 6 which extend, like ferromagnetic rods 5, over the entire height of the waveguide. Cylinders 6 are sealed at the interior sides of the waveguide walls by gaskets 25. Through openings 7 in a wall of the waveguide, a gas or liquid is introduced into these dielectric hollow cylinders 6 and is discharged again through openings 8 in the opposite waveguide wall.

The magnetic system which produces the static magnetic field for ferromagnetic rods 5 is composed of pole pieces 9 and 10 disposed on both waveguide walls above and below rods 5 and of permanent magnets 11 and 12 disposed thereabove as well as a yoke 13 to close the magnetic circuit. To permit a cooling liquid or gas to be introduced or discharged through openings 7 and 8, respectively, into dielectric hollow cylinders 6 in waveguide arm 2, pole pieces 9 and 10 of the magnetic system, which cover openings 7 and 8, are provided with intake and discharge channels 14 and 15, respectively. Pole pieces 9 and 10 are sealed to the walls of waveguide arm 2 by gaskets 27. The openings 7 and 8 in the waveguide walls are dimensioned that they do not permit the high frequency field to pass through.

Further openings 16 and 17, which also do not permit the high frequency field to pass through, bring ferromagnetic rods 5 up to pole pieces 9 and 10. On one hand, this provides for easy mounting of ferromagnetic rods 5 and, on the other hand, the direct contact between ferromagnetic rods 5 and pole pieces 9 and 10 keeps the magnetic transfer resistance low between magnets 11 and 12 and ferromagnetic rods 5.

Instead of arranging ferromagnetic rods 5 individually or in groups in a plurality of dielectric hollow cylinders 6, as in waveguide arm 2, all ferromagnetic rods 5 may also be accommodated together in an elongate dielectric container 18 installed parallel to a narrow side of the waveguide, as is the case of waveguide arm 3 (see FIG. 1).

Figure 4:
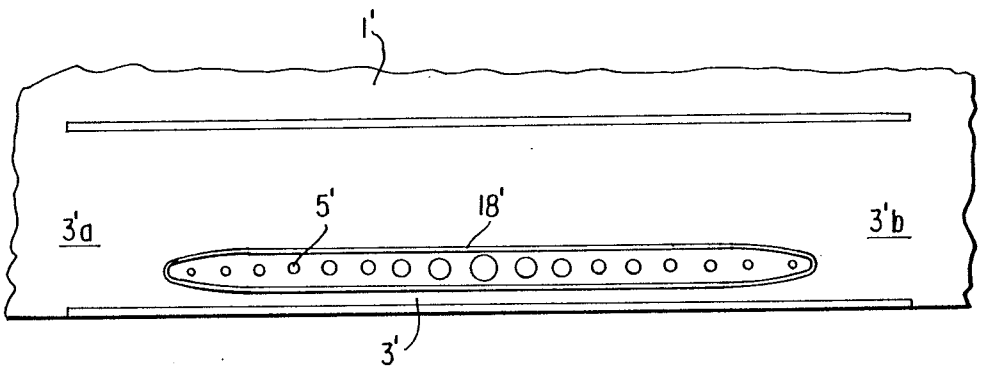
FIG. 4 is a plan view of one waveguide arm of a phase shifter circulator in which ferromagnetic rods have different diameters.

It is advisable to permit the quantity of ferromagnetic material to gradually increase from the waveguide inputs and outputs toward the interior of the waveguide. For example, in waveguide arm 2 a single rod 5 is disposed in the cylinder 6 closest to port 2*a*, two rods 5 are disposed in the next cylinder 6, and thereafter three rods 5 are disposed in each cylinder 6 until the approach of phase shifter port 2*b*. That is, the number of ferromagnetic rods 5 disposed in a dielectric hollow cylinder 6 increases from hollow cylinder to hollow cylinder towards the interior of waveguide arm 2. An alternative way to gradually change the quantity of ferromagnetic material would be to decrease the spacing between ferromagnetic rods 5 in the direction toward the interior of the waveguide as in the embodiment of waveguide arm 3. Another alternative would be to increase the thickness of the ferromagnetic rods 5 from rod to rod toward the interior of the waveguide as shown in FIG. 4. FIG. 4 illustrates a waveguide arm 3' of a magic T waveguide junction 1', between ports 3'*a* and 3'*b*. This thickness of ferromagnetic rods 5', which are disposed in dielectric container 18', increases toward the interior as shown.

To ensure entrance of the high frequency field into the waveguide arm 3 with the least amount of reflection, the dielectric container 18 tapers toward the ports 3*a* and 3*b*, in addition to the density of the ferromagnetic material therein being graduated. This tapering of dielectric container 18 may occur either continuously as illustrated or in steps.

If the dielectric hollow cylinders 5 equipped with ferromagnetic rods 5 in waveguide arm 2 are arranged at a spacing of approximately a quarter wavelength, particularly broadbanded and low-reflection characteristics result for the phase shifter.

Figure 3:
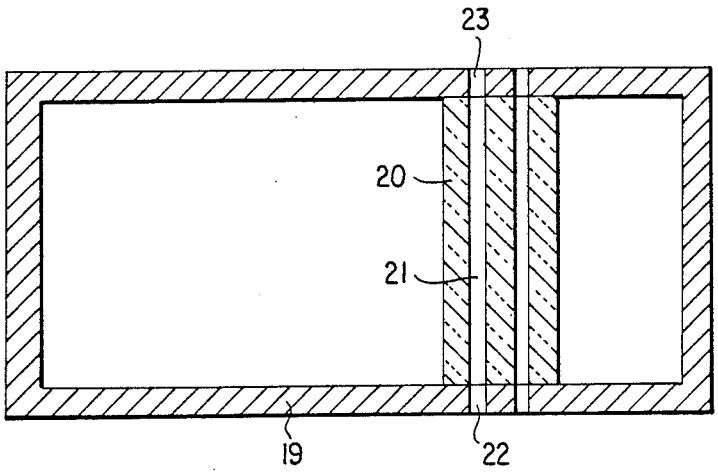
FIG. 3 is a cross-sectional view of a waveguide arm of a phase shifter circulator in which the ferromagnetic material has a different structure than shown in FIG. 1.

According to the embodiments shown in FIGS. 1 and 2, the ferromagnetic material of the phase shifter is shaped into rods 5. Alternatively, as shown in FIG. 3, an elongate ferromagnetic body 20 provided with bores 21 extending parallel to the static magnetic field may be arranged in a waveguide arm 19 along at least one plane parallel to a narrow side of the waveguide. These bores 21 communicate with openings 22 and 23 in the waveguide walls to permit passage of a cooling fluid (gas or liquid) through ferromagnetic body 20. The bores 21 again define elongated regions which extend from one waveguide wall to the opposite wall, but in this case the elongated regions contain the cooling fluid and are surrounded by ferrite material. Although only waveguide arm 19 and the ferromagnetic body 20 are shown for the phase shifter circulator of FIG. 3, it will be understood that other features such as magnetics for producing the static magnetic field would also be present in practice.

The above-described embodiments of a phase shifter are suitable for use in a phase shifter circulator operated with extremely high high-frequency power as shown above in connection with FIG. 1.

The above described phase shifter circulator can operate in a frequency range of 250 MHz to 18 GHz.

One specific embodiment of the phase shifter circulator which operates at 500 MHz is dimensioned as follows:

Both waveguide arms 2 and 3 have a wide side of 457.2 mm and a narrow side of 228.6 mm. In some applications it will be advantageous to reduce the narrow side (e.g. 114.3 mm).

The ferromagnetic rods 5 are shown in FIG. 1 and the bores 21 in the ferromagnetic body 20 as shown in FIG. 3 have a diameter in the range of 2 to 4 mm.

The spacing between the rods 5 in waveguide arm 3 and the spacing between the bores 21 is in the range 2 to 4 mm.

The dielectric cylinders 6 as shown in FIG. 1 have a diameter of approximately one eighth of the waveguide wavelength and they are spaced from one another at about one quarter of the wavelength.

The present disclosure relates to the subject matter disclosed in European Patent Application EP 897 102 471.7 of Feb. 21st, 1987, the entire disclosure of which is incorporated herein by reference.

It will be understood that the above description of the present invention is susceptible to various modifications, changes and adaptations, and the same are intended to be comprehended within the meaning and range of equivalents of the appended claims.

We claim:

1. A phase shifter, comprising:

a waveguide for conveying an electromagnetic wave along a path in a direction of wave propagation, the waveguide having a pair of opposing waveguide walls;

means for generating a static magnetic field inside the waveguide, the static magnetic field being oriented parallel to the high frequency electrical field of the electromagnetic wave; and means for rotating the phase of an electromagnetic wave conveyed by the waveguide without unnecessarily attenuating the electromagnetic wave, the means for rotating including ferromagnetic material disposed along at least one plane extending in the direction of wave propagation and parallel to the high frequency electrical field of the electromagnetic wave, the ferromagnetic material being shaped to define a plurality of three-dimensional elongated regions which extend in the direction of the static magnetic field from one waveguide wall to the opposite waveguide wall, wherein the strength of the static magnetic field is selected so that the ferromagnetic material does not operate at gyromagnetic resonance.

2. The phase shifter of claim 1, further comprising means for surrounding the ferromagnetic material by a fluid dielectric material serving as a coolant.

3. The phase shifter of claim 1, wherein the ferromagnetic material is shaped into rods.

4. The phase shifter of claim 1, wherein the waveguide has a port, and wherein the quantity of ferromagnetic material gradually increases from the port in the direction toward the interior of the waveguide.

5. A phase shifter, comprising:

a waveguide for conveying an electromagnetic wave along a path in a direction of wave propagation, the waveguide having a narrow side and having a pair of opposing waveguide walls;

means for generating a static magnetic field inside the waveguide, the static magnetic field being oriented parallel to the high frequency electrical field of the electromagnetic wave;

ferromagnetic material disposed along at least one plane extending in the direction of wave propagation and parallel to the high frequency electrical field of the electromagnetic wave, the ferromagnetic material being shaped into a plurality of rods which extend in the direction of the static magnetic field from one waveguide wall to the opposite waveguide wall; and means for surrounding the rods with a fluid serving as a coolant, the means for surrounding the rods including a plurality of dielectric cylinders arranged along at least one plane extending parallel to the narrow side of the waveguide, the rods being disposed in the cylinders.

6. The plane shifter of claim 5, wherein at least one of the dielectric cylinders surrounds a plurality of rods.

7. A phase shifter, comprising:

a waveguide for conveying an electromagnetic wave along a path in a direction of wave propagation, the waveguide having a narrow side and having a pair of opposing waveguide walls;

means for generating a static magnetic field inside the waveguide, the static magnetic field being oriented parallel to the high frequency electrical field of the electromagnetic wave;

ferromagnetic material disposed along at least one plane extending in the direction of wave propagation and parallel to the high frequency electrical field of the electromagnetic wave, the ferromagnetic material being shaped into a plurality of rods which extend in the direction of the static magnetic field from one waveguide wall to the opposite waveguide wall; and means for surrounding the rods with a fluid serving as a coolant, the means for surrounding the rods including an elongated dielectric container disposed along at least one plane extending parallel to the narrow side of the waveguide, the rods being disposed in the container.

8. A phase shifter, comprising:

a waveguide for conveying an electromagnetic wave along a path in a direction of wave propagation, the waveguide having a pair of opposing waveguide wall;

means for generating a static magnetic field inside the waveguide, the static magnetic field being oriented parallel to the high frequency electrical field of the electromagnetic wave; and ferromagnetic material disposed along at least one plane extending in the direction of wave propagation and parallel to the high frequency electrical field of the electromagnetic wave, the ferromagnetic material being shaped into a plurality of rods which extend in the direction of the static magnetic field from one waveguide wall to the opposite waveguide wall, wherein the opposing waveguide walls have openings through which the rods extend, the openings being dimensioned to prevent the high frequency field from passing through.

9. A phase shifter, comprising:

a waveguide for conveying an electromagnetic wave along a path in a direction of wave propagation, the waveguide having a port and having a pair of opposing waveguide walls;

means for generating a static magnetic field inside the waveguide, the static magnetic field being oriented parallel to the high frequency electrical field of the electromagnetic wave; and ferromagnetic material disposed along at least one plane extending in the direction of wave propagation and parallel to the high frequency electrical field of the electromagnetic wave, the ferromagnetic material being shaped into a plurality of rods which extend in the direction of the static magnetic field from one waveguide wall to the opposite waveguide wall, wherein the thickness of the rods increases from rod to rod from the port in the direction toward the interior of the waveguide.

10. A phase shifter, comprising:

a waveguide for conveying an electromagnetic wave along a path in a direction of wave propagation, the waveguide having a port and having a pair of opposing waveguide walls;

means for generating a static magnetic field inside the waveguide, the static magnetic field being oriented parallel to the high frequency electrical field of the electromagnetic wave; and ferromagnetic material disposed along at least one plane extending in the direction of wave propagation and parallel to the high frequency electrical field of the electromagnetic wave, the ferromagnetic material being shaped into a plurality of rods which extend in the direction of the static magnetic field from one waveguide wall to the opposite waveguide wall, wherein the distance between adjacent rods decreases from the port in the direction toward the interior of the waveguide.

11. A phase shifter, comprising:

a waveguide for conveying an electromagnetic wave along a path in a direction of wave propagation, the waveguide having a pair of opposing waveguide walls, the waveguide additionally having a port and a narrow side;

means for generating a static magnetic field inside the waveguide, the static magnetic field being oriented parallel to the high frequency electrical field of the electromagnetic wave; and ferromagnetic material disposed along at least one plane extending in the direction of wave propagation and parallel to the high frequency electrical field of the electromagnetic wave, the ferromagnetic material being shaped into a plurality of rods which extend in the direction of the static magnetic field from one waveguide wall to the opposite waveguide wall; and means for surrounding the rods with a fluid serving as a coolant, the means for surrounding the rods including a plurality of dielectric cylinders arranged along at least one plane extending through the port and parallel to the narrow side of the waveguide, wherein the rods are disposed in the cylinders, with the number of rods in a cylinder increasing from cylinder to cylinder from the pot in the direction toward the interior of the waveguide.

12. A phase shifter, comprising:

a waveguide for conveying an electromagnetic wave along a path in a direction of wave propagation, the waveguide having a narrow side and having a pair of opposing waveguide walls;

means for generating a static magnetic field inside the waveguide, the static magnetic field being oriented parallel to the high frequency electrical field of the electromagnetic wave; and an elongated ferromagnetic body disposed along at least one plane parallel to the narrow side of the waveguide and extending in the direction of wave propagation, the ferromagnetic body additionally extending from one waveguide wall to the opposite waveguide wall and having a plurality of bores which extend through the ferromagnetic body parallel to the static magnetic field from one waveguide wall to the opposite waveguide wall and which conduct fluid to cool the ferromagnetic body.

* * * * *